US005827161A

United States Patent [19]

Petit

[11] Patent Number: 5,827,161

[45] Date of Patent: Oct. 27, 1998

[54] PROCESS FOR THE FABRICATION OF A KRAFT PAPER DRUM AND MEANS FOR IMPLEMENTING THIS PROCESS

[75] Inventor: Pascal Petit, Villeneuve d' Ascq, France

[73] Assignee: Georges Petit, S.A., Tourcoing, France

[21] Appl. No.: 678,589

[22] Filed: Jul. 12, 1996

[30] Foreign Application Priority Data

Jul. 12, 1995 [FR] France ..... 95 08687

[51] Int. Cl.[6] ..... B31B 1/90

[52] U.S. Cl. ..... 493/102; 493/84; 493/89; 493/115; 493/136; 493/158; 72/110

[58] Field of Search ..... 493/84, 87, 89, 493/104, 105, 92, 102, 103, 106, 107, 108, 109, 112, 115, 128, 136, 152, 154, 155, 156, 157, 158, 162, 379; 413/73, 75, 76; 72/86, 87, 110, 126

[56] References Cited

U.S. PATENT DOCUMENTS

| | | | |
|---|---|---|---|
| 1,038,715 | 9/1912 | Beadle . | |
| 1,125,042 | 1/1915 | Beadle | 493/159 |
| 1,155,787 | 10/1915 | Bohlman | 493/159 |
| 1,335,232 | 3/1920 | Hammer . | |
| 2,281,889 | 5/1942 | Stuart . | |
| 2,286,692 | 6/1942 | Smith | 493/159 |
| 3,126,798 | 3/1964 | Fairchild | 493/158 |
| 3,229,595 | 1/1966 | Waycie | 493/104 |
| 3,336,847 | 8/1967 | Durat | 493/158 |
| 3,402,874 | 9/1968 | Sternau | 493/102 |
| 3,633,469 | 1/1972 | Kinney . | |
| 5,083,994 | 1/1992 | Seufert | 493/84 |
| 5,215,248 | 6/1993 | Moser | 493/84 |
| 5,477,720 | 12/1995 | Lentz | 72/126 |
| 5,556,364 | 9/1996 | Konzal | 493/159 |
| 5,640,867 | 6/1997 | Massee | 72/86 |

FOREIGN PATENT DOCUMENTS 841869 3/1939 France .

*Primary Examiner*—John Sipos
*Assistant Examiner*—Christopher W. Day
*Attorney, Agent, or Firm*—Kerkam, Stowell, Kondracki & Clarke, P.C.; Edward J. Kondracki; John C. Kerins

[57] ABSTRACT

The invention relates to a process for the fabrication of a drum made of kraft paper according to which a sheet of kraft paper is rolled on a mandril so as to constitute a rotating cylindrical tube. The end of the tube which forms the bottom is rolled with more than one turn and receives a disk which constitutes the bottom of the drum. The disk is then placed on the ridge (8) formed by the rolled edge, and a retaining collar (10) is placed around the tube. The collar is then tightened to clamp the disk (3A) onto the tube.

9 Claims, 3 Drawing Sheets

FIG. 2
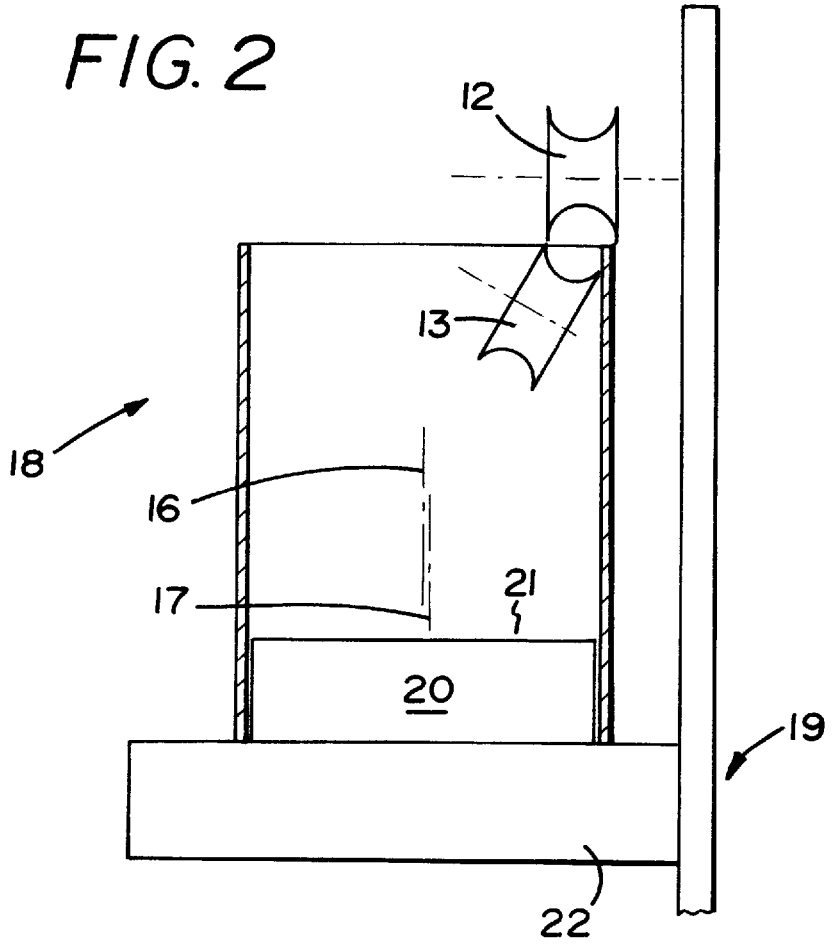
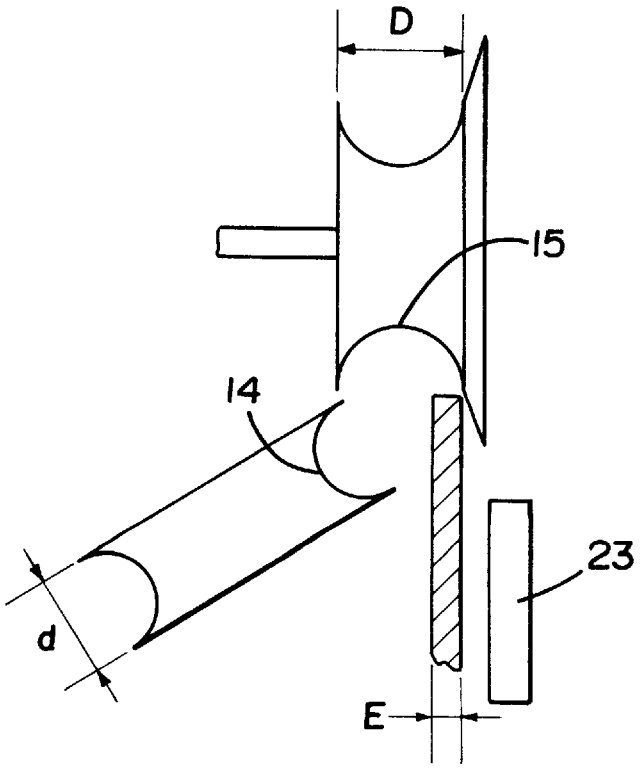
FIG. 3

PROCESS FOR THE FABRICATION OF A KRAFT PAPER DRUM AND MEANS FOR IMPLEMENTING THIS PROCESS

FIELD OF THE INVENTION

The invention relates to a process for the fabrication of a kraft paper drum.

It also relates to means for the implementation of this process and to the drums thus obtained.

DESCRIPTION OF THE RELATED ART

For the transportation and handling of granular products, it is customary to make use of cylindrical packages made of kraft paper.

In order to obtain these drums as shown, for example, in Belgium Patent A 1.004.344:

- a sheet of kraft paper is rolled on a mandril so as to constitute a rotating cylindrical tube;
- one of the ends of the tube is sealed with a disk so as to constitute a bottom,
- the other end of the tube is formed in such a way that a lid can be removably fastened to it.

In order to attach the disk which will constitute the bottom of the drum:

- a metal ferrule or a hoop is used, which is placed around the tube into which the disk is inserted and
- the metal ferrule or hoop, along with the edge of the tube, is rolled over itself toward the inside of the tube, so that this rolled edge crimps the edge of the disk and lodges it inside the tube.

The edge is rolled with one turn at most.

In order to improve the rigidity of the drum, the ferrule and the tube are both deformed in a radial plane situated above the rolled edge and the disk so as to create a rib which projects inside the tube.

A ferrule or hoop is also placed at the other end of the tube and is also rolled over itself along with the end of the tube.

This ferrule is also deformed so as to create a rib, which makes it possible to engage the lower lip of the retaining collar of a lid.

The creation of a rolled edge poses no problem as long as the wall of the tube to be rolled is thin or is made of a material having plastic properties such as metal, but it proves difficult when the thickness of the tube is more substantial and when the material does not have plastic properties.

When the thickness of the tube increases, it is known, as shown in French Patent 2.437.294, to effect a prior softening of the material in the area of the tube to be rolled by creating circular grooves produced by indenting the material.

This is only worthwhile when the material which constitutes the tube is relatively soft, which is not the case with drums made of kraft paper.

For these kraft paper drums, the use of metal ferrules has always been considered to be the essential fitting for rolling the edge of the tube.

In effect, kraft paper is a material which is difficult to plastically deform, and this metal piece makes it possible to roll it with approximately one turn.

Unfortunately, when one desires to retrieve the paper which constitutes the drum in order to recycle it, it is first necessary to remove the metal ferrule.

No methods for carrying out this operation are known other than the manual method.

In addition to taking a long time, this operation is very difficult.

In order to remedy this, yet still comply with legislation which is more and more stringent, users generally replace cardboard drums with drums made entirely of synthetic material which does not require any intermediate operation in order to be recycled, provided that a suitable synthetic material is chosen.

However, these recycling processes are much more costly than paper recycling.

SUMMARY OF THE INVENTION

One of the results that the invention seeks to obtain is a process for the fabrication of a drum made of kraft paper which eliminates the above-mentioned drawbacks and to this end, the subject of the invention is a process of this type for the fabrication of a kraft paper drum, according to which:

- a sheet of kraft paper is rolled on a mandril so as to constitute a rotating cylindrical tube,
- one of the ends of the tube is sealed with a disk so as to constitute a bottom,
- the other end of the tube is formed in such a way that a lid can be removably fastened to it.

This process is particularly characterized in that:

- the end of the tube for receiving the disk which forms the bottom is rolled with more than one turn,
- the disk which will constitute the bottom is then placed on the ridge formed by the rolled edge,
- a retaining collar is placed around the tube, and
- this collar is tightened so as to clamp the disk onto the tube.

The invention also relates to means for the implementation of this process and to the drums thus obtained.

BRIEF DESCRIPTION OF THE DRAWINGS

The invention will be clearly understood with the aid of the description below, given as a non-limiting example in reference to the appended drawings, which schematically represent:

FIG. 2: an installation for implementing the process,

FIG. 3 an enlarged detail of the installation in FIG. 2,

DESCRIPTION OF THE PREFERRED EMBODIMENTS

Figure 1:
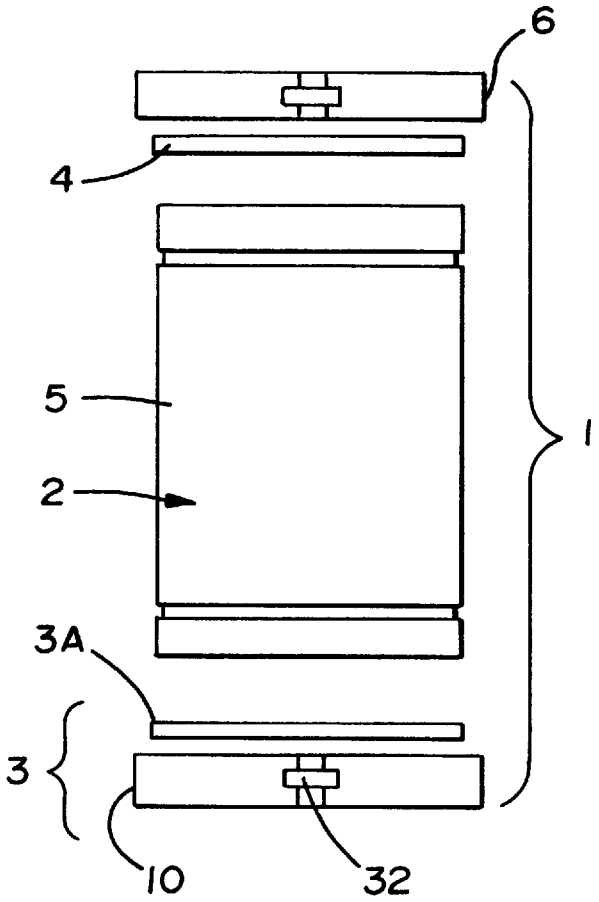
FIG. 1: an exploded view of a drum according to the invention.
Figure 4:
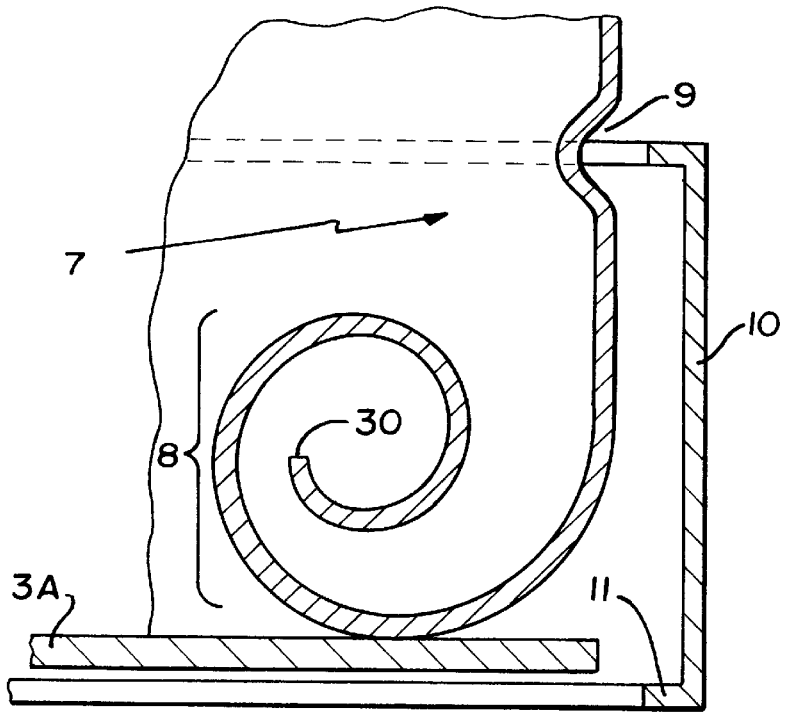
FIG. 4 a detail of the drum in axial section.
Figure 5:
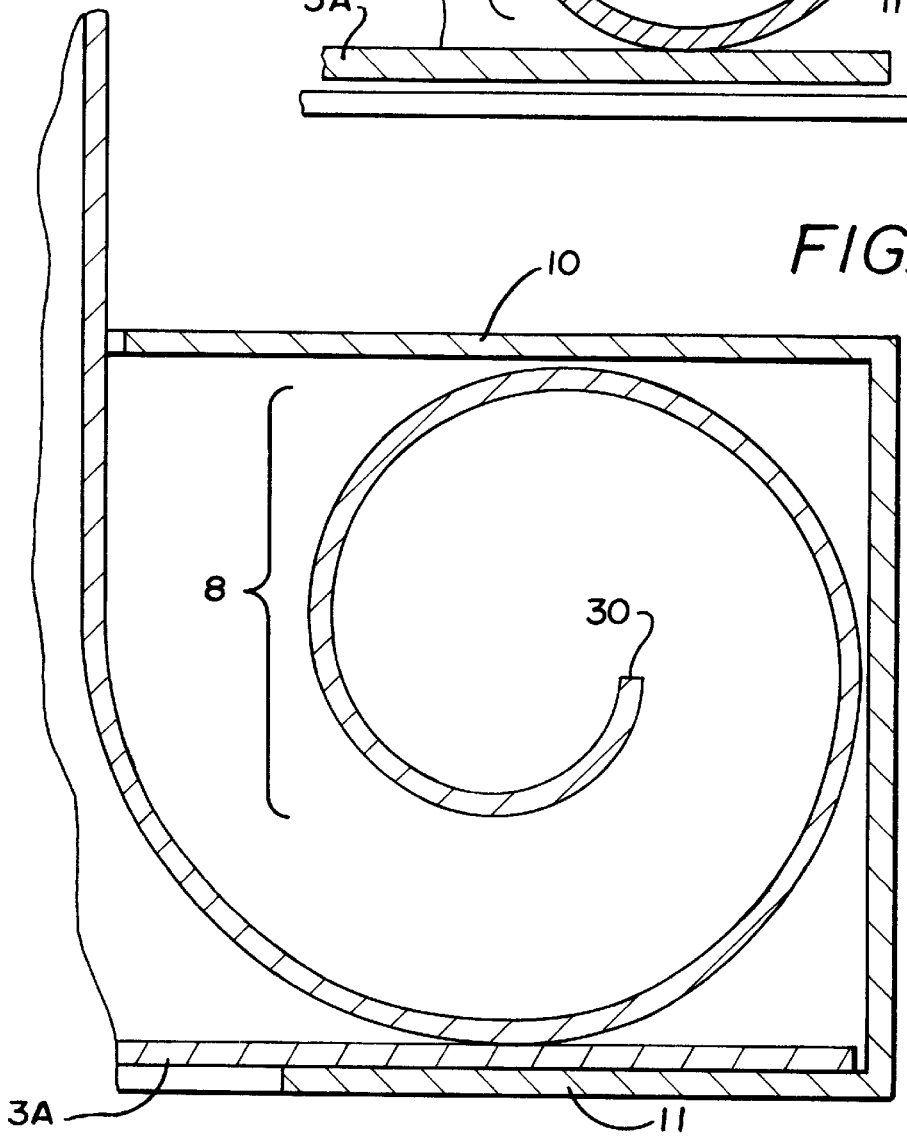
FIG. 5 a detail of another drum in axial section.

Referring to the drawings, it is possible to see that a drum 1 comprises:

- a globally cylindrical rotating shell 1,
- a bottom 3, and
- a removable lid 4 held on the body 5 of the drum by a retaining collar 6 which, when seen in axial section, has a C shape.

Classically, in order to constitute the drum:

- a sheet of kraft paper is rolled on a mandril so as to constitute a rotating cylindrical tube,
- one of the ends of the tube is sealed with a disk 3A so as to constitute a bottom 3, and
- the other end of the tube is formed in such a way that a lid 4 can be removably fastened to it.

According to an essential characteristic of the process which is a subject of the invention:

the end of the tube for receiving the disk 3A which forms the bottom is rolled with more than one turn, the disk 3A which will constitute the bottom is placed on the ridge 8 formed by the rolled edge, a retaining collar 10 is placed around the tube, and this collar is tightened so as to clamp the disk 3A onto the tube.

Before the placement of the disk, it is possible to deposit a line of adhesive on the area of the disk which comes into contact with the ridge.

Obviously, it is also possible to deposit the adhesive on the ridge instead of the disk.

Advantageously, at the level of the area 7 of the tube situated above the rolled edge 8, the wall is deformed toward the inside of the tube so as to create a groove 9 which makes it possible to receive a retaining collar 10 which is adjusted around the shell.

Advantageously, the rolling of the rolled edge is carried out before the cylindrical tube formed by rolling the kraft paper has completely dried.

The end of the tube is rolled with at least one and a half turns, and preferably with at least two turns.

In order to create the rolled edge:

first, a piece of machinery is constituted, which comprises:

a first roller 12 with a semi-circular groove, the diameter D of which groove is predetermined, a second roller 13 with a semi-circular groove, the diameter d of which groove is equal to the diameter D of the groove of the first roller minus a value at least equal to the thickness E of the tube to be rolled, which second roller can be moved between two positions, an active position (FIG. 2) in which locally, on the one hand, the generatrix 14 of the semi-circular groove of this second roller 13 is positioned opposite the generatrix of the first roller and, on the other hand, one of the edges of this second generatrix is placed opposite one of the edges of the generatrix of the first roller and extends the generatrix of the semi-circular groove of the first roller 12 in such a way that these two generatrices 14, 15 define a spiral, and an inactive position (FIG. 3) in which the second roller 13 is separated from the first roller, the edge of the tube to be rolled is progressively engaged inside the spiral defined by the generatrices 14, 15 of the above-mentioned rollers 12, 13, and one of the elements, either the tube to be rolled or the piece of machinery formed by the two above-mentioned rollers, is driven in rotation around an axis 16 coaxial to the longitudinal axis 17 of the tube to be rolled.

Preferably, the tube to be rolled is driven in rotation and the machinery is kept fixed.

It is only when the upper edge of the tube comes into contact with the first roller that the second roller is moved into the active position.

The disk is placed either on the area of the ridge turned toward the outside of the tube, or on the area of the ridge turned toward the inside of the tube.

Preferably, the other end of the tube is also rolled with more than one turn so as to constitute a rolled edge, and in the area of the tube situated underneath the rolled edge, the wall is deformed toward the inside in order to create a groove which can receive the lower lip of a clamp collar with a cross section which is substantially C-shaped.

Possibly, when the tube formed by rolling is too dry, for example when the time elapsed between the rolling of the kraft paper and the formation of the rolled edge is too long, the tube is rehumidified enough to make the kraft paper malleable again.

Thus, a drum is obtained which is produced by rolling a sheet of kraft paper on a mandril and which comprises, at least at one of its ends, an edge rolled toward the inside or the outside, in which the amplitude of the rolling is more than one turn, and preferably at least one and a half turns.

The amplitude of the rolling, and thus the thickness of the ridge, are determined so as to receive the disk which constitutes the bottom of the drum in simple support.

Near the rolled edge, the cylindrical shell of the drum as seen from the outside has a groove which can receive the edge of a retaining belt, which retaining belt is in the form of a band having a solution of continuity and comprising means for clamping the reinforcing belt around the drum.

This could be done with a bevel closure.

Thus, it is easy to separate the metal part constituted by the belts of the kraft paper tube from the disks which form the bottom or the lid.

This facilitates recycling.

The means for implementing the process chiefly comprise means 18 for rolling the end of the tube with more than one turn so as to produce a ridge which can receive a disk in simple support.

These means comprise, in particular:

a first roller 12 with a semi-circular groove, the diameter D of which groove is predetermined, a second roller 13 with a semi-circular groove, the diameter of which groove is equal to the diameter D of the groove of the first roller minus a value at least equal to the thickness E of the tube to be rolled, the second roller can be moved between two positions, an active position in which locally, on the one hand, the generatrix 14 of the semi-circular groove of this second roller 13 is positioned opposite the generatrix of the first roller and, on the other hand, one of the edges of this second generatrix is placed opposite one of the edges of the generatrix of the first roller and extends the generatrix 15 of the semi-circular groove of the first roller 12 in such a way that these two generatrices 14, 15 define a spiral loop, and an inactive position in which the second roller is separated from the first roller, means 19 for progressively engaging the edge of the tube to be rolled inside the spiral defined by the generatrices of the above-mentioned rollers, and means 20 for driving one of the elements, either the tube to be rolled or the piece of machinery formed by the two above-mentioned rollers, in rotation around an axis coaxial to the longitudinal axis of the tube to be rolled.

Preferably, it is the tube to be rolled which is driven in rotation.

This tube to be rolled is fastened onto a mandril 21 attached to a bracket 22.

Means for respectively displacing the bracket and the machinery progressively engage the tube in the space delimited by the two rollers in the active position.

In a preferred embodiment, it is the machinery which is moved into contact with the drum.

When the edge is rolled, the second roller is tilted into the passive position so that the rolled edge can be released.

Means 23 are provided for guiding the tube in rotation by its part near the machinery.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the spirit and scope of the invention as set forth herein and defined in the claims.

I claim:

1. A process for fabricating a drum made of kraft paper comprising forming a sheet of kraft paper into a cylindrical tube, having open opposite ends sealing a first end of the tube with a disk (3A) to form a bottom 3) of the drum, forming a second end of the tube to receive a lid (4) thereon, wherein said step of sealing said first end of the tube includes rolling said first end through more than 360 degrees around a central axis to form a rolled edge at the bottom of the tube so as to strengthen structural integrity of the rolled edge and assist in preventing unrolling of the rolled edge, placing the disk (3A) which constitutes the bottom at a lower extent of said rolled edge, placing an adjustable retaining collar (10) over said rolled edge and said disk, and tightening said collar about said rolled edge and said disk so as to clamp the disk (3A) onto the tube.

2. The process according to claim 1 wherein the rolled edge of the tube is rolled to be disposed radially inwardly of said tube.

3. The process according to claim 1 wherein the rolled edge of the tube is disposed radially outwardly of said tube.

4. The process according to claim 1, comprising the further step of forming said rolled edge into a spiral by providing a first roller (12) having a semi-circular groove of a predetermined diameter (D) and a first generatrix (15), a second roller (13) having a semi-circular groove, having a diameter (d) equal to the predetermined diameter (D) of the groove of the first roller minus a value (C) at least equal to a thickness (E) of the tube to be rolled, and a second generatrix (14), the second roller being movable between a first active position and a second inactive position, said active position being that in which the generatrix (14) of the semi-circular groove of said second roller (13) is positioned opposite the generatrix (15) of the first roller, and wherein one of the edges of said second generatrix (14) is placed opposite one of the edges of the generatrix (15) of the first roller and extends the generatrix (15) of the semi-circular groove of the first roller (12) such that said first and second generatrices (14, 15) are positioned to roll kraft paper into a spiral loop, said inactive position being that in which the second roller (13) is separated from the first roller (12), and progressively axially advancing the first end of the tube into the generatrices (14, 15) of the first and second rollers (12, 13) to roll said paper into a spiral, and rotating one of said tube and said first and second rollers around an axis (16) coaxial to a longitudinal axis (17) of said tube.

5. The process according to claim 1 including the step of radially inwardly deforming an area (7) of the tube disposed above the rolled edge (8) to create a groove (9) extending around the tube for receiving said retaining collar (10).

6. The process according to claim 1 including the step of rolling said second end of the tube through more than 360 degrees around a central axis to form an upper rolled edge, and radially inwardly deforming an area of the wall of the tube situated underneath the upper rolled edge to create a groove for receiving a lower lip of a clamp collar with a cross-section which is substantially C-shaped.

7. Apparatus for the fabrication of a drum made of kraft paper, including means for forming a sheet of kraft paper on a mandrel such that said sheet of kraft paper constitutes a rotating cylindrical tube having an upper end and a lower bottom end, means for sealing the bottom end of the tube to a closure disk (3A) means for forming the upper end of the tube in such a way that a lid (4) can be removably fastened to the upper end, and means for rolling the lower end of the tube through more than 360 degrees around a central axis so as to produce a ridge to which said closure disk may be sealed in forming the bottom of the tube so as to strengthen structural integrity of the rolled edge and assist in preventing unrolling of the rolled edge.

8. Apparatus for the fabrication of a kraft paper drum according to claim 7, wherein the means for rolling comprises:

a first roller (12) with a semi-circular groove having a first predetermined diameter (D), a second roller (13) with a semi-circular groove having a second diameter (d) equal to the first predetermined diameter (D) of the groove of the first roller minus a value (C) at least equal to the thickness (E) of the tube to be rolled, said second roller (13) being movable between an active and an inactive position, wherein, in the active position, a generatrix (14) of the semi-circular groove of this second roller extends a generatrix (15) of the semi-circular groove of the first roller in such a way that these two generatrices (14, 15) define a spiral loop, and wherein, in the inactive position, the second roller (13) is separated from the first roller (12), means (19) for progressively advancing the lower end of the tube into the generatrices of the first and second rollers, and means (20) for driving at least one of the tube to be rolled and the rollers, in rotation around an axis coaxial to a longitudinal axis of the tube to be rolled.

9. Apparatus for the fabrication of a kraft paper drum according to claim 8, wherein the means for driving comprises a mandrel (21) attached to a bracket (22) which receives the tube, and further includes means for relatively displacing the bracket (22) and the means for progressively advancing said lower end of the tube with respect to one another.

* * * * *